US006561198B1

(12) United States Patent
Drevillon et al.

(10) Patent No.: US 6,561,198 B1
(45) Date of Patent: May 13, 2003

(54) METHOD AND INSTALLATION FOR TREATING A METAL PART SURFACE

(75) Inventors: Bernard Drevillon, Clamart (FR); Nicolas Bertrand, Paris (FR); Jean-Christophe Rostaing, Buc (FR)

(73) Assignee: L'Air Liquide Societe Anonyme a Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/623,456

(22) PCT Filed: Mar. 5, 1999

(86) PCT No.: PCT/FR99/00507

§ 371 (c)(1),
(2), (4) Date: Nov. 6, 2000

(87) PCT Pub. No.: WO99/46428

PCT Pub. Date: Sep. 16, 1999

(30) Foreign Application Priority Data

Mar. 10, 1998 (FR) ..... 98 02897

(51) Int. Cl.[7] ..... C25F 5/00

(52) U.S. Cl. ..... 134/1.1; 134/2; 134/15; 134/43; 118/723 MW; 118/723 ME; 118/723 MR; 118/723 MA; 156/345; 315/111.21; 315/111.41; 216/69; 216/70; 638/726; 638/728

(58) Field of Search ..... 134/1.1, 2, 15, 134/42; 118/723 MW, 723 ME, 723 MR, 723 MA; 156/345; 315/111.21, 111.41; 216/69, 70; 438/726, 728

(56) References Cited

U.S. PATENT DOCUMENTS 5,216,329 A * 6/1993 Pelleteir ..... 204/298.37
5,306,379 A * 4/1994 Kamide ..... 156/345
5,376,223 A 12/1994 Salimian et al.
5,637,150 A * 6/1997 Wartski et al. ..... 118/723 AN

FOREIGN PATENT DOCUMENTS

| | | |
|---|---|---|
| DE | 40 39 853 | 6/1991 |
| EP | 0 371 693 | 6/1990 |
| EP | 0 483 839 | 5/1992 |
| EP | 0 780 485 | 6/1997 |

OTHER PUBLICATIONS

A. Grill. Plasma in Materials Fabrication. IEEE PRESS, MY, 1993. Pges 39–40 and 104–105.*

Sakamoto, Y.: "Reduction of Metal Oxides by Electron Cyclotron Resonance (ECR) Plasma of Hydrogen—A Model Study on Discharge Cleaning", Japanese Journal of Applied Physics, vol. 19, No. 5, May 1, 1980, pp. 839–843.

"Low Temperature Process for Surface Cleaning", Research Disclosure, No. 309, Jan. 1, 1990, p. 82.

"Plasmareinigen im groβen Stil", MO Metalloberflache, vol. 49, No. 9, Sep. 1, 1995, p. 702.

* cited by examiner

*Primary Examiner*—Alexander Markoff
*Assistant Examiner*—M. Kornakov
(74) *Attorney, Agent, or Firm*—Burns, Doane, Swecker & Mathis, L.L.P.

(57) ABSTRACT

In this method for the surface treatment of a metal part (12) for the purpose of deoxidizing it and/or cleaning it, a sealed chamber (16), in which the part to be treated is placed, is filled with a low-pressure reducing gas mixture, a static magnetic field is created in a region of the chamber (16) separate from the region in which the part (12) to be treated is placed and the gas mixture is excited by means of an electromagnetic wave injected into the chamber (16) so as to generate a treatment plasma in the gas, the intensity of the static magnetic field corresponding to electron cyclotron resonance established in the chamber in a distributed manner.

20 Claims, 3 Drawing Sheets

METHOD AND INSTALLATION FOR TREATING A METAL PART SURFACE

BACKGROUND OF THE INVENTION

1. Field of the Invention

The present invention relates to the surface treatment of large metal parts for the purpose of deoxidizing them and/or of cleaning them, with reference especially to the metal sheets as they are presented when leaving a rolling mill, in order to modify its [sic] surface properties while maintaining its [sic] volume properties.

Such a part generally has, on the surface, irregularities having a size of about 0.1 to 0.5 $\mu$m, lubrication residues and traces of oxidation, which make coatings applied to this surface poorly adherent.

2. Description of the Related Art

In general, the preparation of the surface of a thin sheet for the purpose of subsequently treating it, and in particular for the purpose of increasing the adhesion of coatings applied to this surface, comprises a necessary step of cleaning and deoxidizing the sheet.

To do this, a widely-used surface treatment technique consists in immersing the part to be treated in an acid or base chemical bath or in an organic solvent.

Although this type of technique makes it possible to treat parts having relatively large dimensions, and to do so at a relatively high rate, it is accompanied by the emission of environmentally harmful effluents.

It has also been proposed, for example in document U.S. Pat. No. 5,376,223 or else in the article by Sakamoto et al., published in the Japanese Journal of Applied Physics in May 1980 (page 839), that use be made of a hydrogen plasma under ECR (Electron Cyclotron Resonance) conditions to carry out surface treatments especially on silicon.

It is known that ECR is one particular way of coupling the energy of an electromagnetic field into the electrons of a plasma in order to sustain the latter.

Both the abovementioned documents are representative of the conventional method used for producing an ECR plasma reactor, which method consists in injecting microwaves from a waveguide into a vacuum chamber through a dielectric window (by way of illustration, chamber 1, waveguide 5 and window 4 in FIG. 1 of the abovementioned US document).

In-depth studies by the Applicant in this field have shown that such a configuration is not satisfactory for the application intended according to the present invention, i.e. for surface treatment allowing the surface properties of large sized metal parts, particularly metal sheets, to be modified.

This is because a static magnetic field is created in the relatively extensive volume region of the chamber by induction coils (referenced 2 in FIG. 1 already mentioned). It therefore appears that the region in which the plasma is created by energy transfer from the microwave field to the electrons necessarily has a diameter limited by the transverse dimensions of the waveguide, even though downstream of the coils the plasma diffuses toward the substrate by extending radially, but nevertheless with the knowledge that this diffusion is, of course, accompanied by a radial density gradient in the plasma.

It should also be emphasized that the magnetic field is not suddenly interrupted outside the coil (2 in the figure already mentioned of the US document), but has a magnetic field gradient which extends beyond the inter-coil space toward the substrate and which has the effect of accelerating the ions in the plasma toward the substrate, this being all the more so when at a large distance from the axis, therefore resulting, as will be understood, in a high radial inhomogeneity.

These studies therefore seem to demonstrate that it is unrealistic to treat substrates having a surface area greater than 200 or 300mm [suc] using such ECR reactors.

SUMMARY AND OBJECT OF THE INVENTION

The object of the invention is to alleviate these drawbacks and to provide a method for the surface treatment of a metal part which can be carried out rapidly, on large areas and near the places where the parts undergo subsequent treatment.

The subject of the invention is therefore a method for the surface treatment of a metal part for the purpose of deoxidizing it and/or cleaning it, characterized in that it comprises the following steps:

filling a sealed chamber, in which the part to be treated is placed, with a low-pressure reducing gas mixture;

creating a static magnetic field in a region of the chamber separate from the region in which the part to be treated is located; and exciting the gas mixture by means of an electromagnetic wave injected into the chamber so as to generate a treatment plasma in the gas, the intensity of the static magnetic field corresponding to an electron cyclotron resonance established in the chamber in a distributed manner.

As will have been understood, the method according to the invention makes it possible to obtain, depending on the initial state of the part, deoxidization and cleaning treatments, this being so by the combination of a static magnetic field created in one region of the chamber separate from that in which the part to be treated lies and of a plasma excitation of the gas mixture allowing "distributed ECR (Electron Cyclotron Resonance)" conditions to be established.

Reference may be made to this literature from the 1980s and 1990s relating to such plasma excitations, including especially the following two articles:

the article by M. Pichot et al., published in Review of Scientific Instruments in 1988, July, Vol. 59, p 1072; and the article by J. Pelletier et al., published in Thin Solid Films in 1994, Vol. 241, p 240.

As will be clearly apparent to those skilled in the art, the method according to the invention adopts "low pressure" conditions, which must be understood to mean pressure conditions allowing actual excitation of the plasma under electron cyclotron resonance (ECR) conditions, whereas at higher pressures the only effect of the magnetic field would be the confinement of the plasma by the multipole magnetic field (magnetron regime). The in-depth studies by the Applicant have shown that this magnetron regime, well known to those skilled in the art, gives results which are substantially lacking as regards the surface treatment application envisioned.

Advantageously, the pressure will therefore be within a range extending from 0.5 to 10 mTorr, and even more preferably within a range extending from 1 to 10 mTorr.

Likewise, the frequency of the incident electromagnetic wave adopted will take into account, on the one hand, the desired ECR regime and also the nature of the gas to be excited without forgetting the practical and technical contingencies of commercial availability and cost (frequencies for domestic use), and those pertaining to the international regulations on radiocommunications.

Taking all these factors into account, it will therefore be preferable to use a frequency of 2.45 GHz, or else a frequency of 5.85 GHz.

It should be understood from the notion of "distributed electron cyclotron resonance" according to the invention that the excitation means used comprise at least one field applicator of tubular overall shape connected to a microwave source, each applicator being equipped with means for creating a static magnetic field in the vicinity of the applicator, over a length corresponding substantially to the entire length of the applicator, with an intensity corresponding to electron cyclotron resonance.

The method according to the invention may furthermore include one or more of the following characteristics, taken separately or in any of the technically possible combinations:

- the electromagnetic wave is injected by means of at least one applicator of tubular overall shape connected to a microwave source, in which applicators permanent magnets are placed;
- the applicator or applicators have a length at least equal to one of the dimensions of the metal part to be treated;
- the gas mixture includes hydrogen;
- the part to be treated consists of a steel sheet running over a substrate holder;
- the method furthermore includes a step consisting in applying a high-frequency electric field to the substrate holder so as to bias both the latter and the part to be treated.

Further characteristics and advantages will emerge from the following description, given solely by way of example and with reference to the appended drawings in which.

DETAILED DESCRIPTION OF PREFERRED EMBODIMENTS

Figure 1:
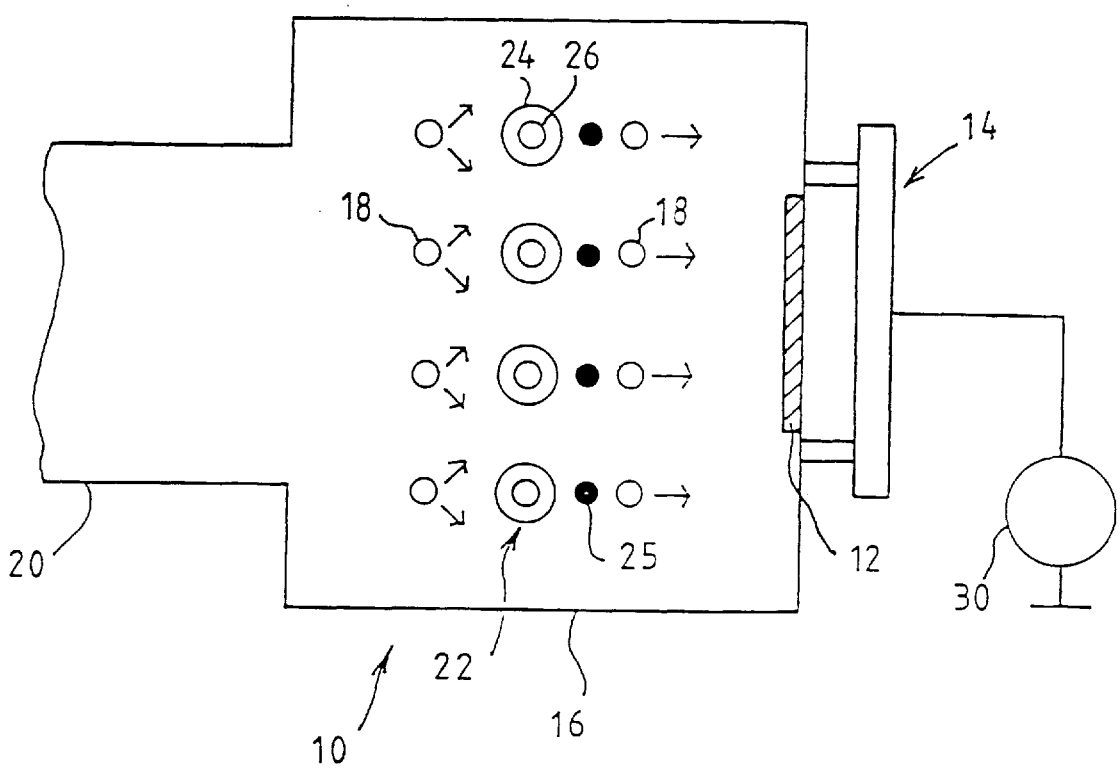
FIG. 1 is a schematic sectional view of a distributed electron cyclotron resonance reactor used for the creation of a treatment plasma according to the invention.

FIG. 1 shows a reactor for the treatment of metal parts, denoted by the overall numerical reference 10.

It is intended to be used for the surface treatment of a part 12, consisting for example of a steel sheet placed on a substrate holder 14, for the purpose of deoxidizing it and/or cleaning it.

As may be seen in this FIG. 1, the chamber 16 includes a set of inlet nozzles such as 18, for a reducing gas mixture.

This chamber is furthermore provided with a duct 20 for connecting the chamber 16 to a pumping station (not shown) allowing the gas delivered by the nozzles 18 to be extracted and allowing the pressure of this gas to be maintained at a desired value, for example between 1 and 10 mTorr.

It may furthermore be seen that the chamber 16 is equipped with a device 22 according to the invention, used for exciting a plasma in the treatment gas to electron cyclotron resonance.

This device 22 consists of several field applicators, such as 24, each having a tubular shape and being connected via one of their ends, by any suitable means, such as a coaxial cable, to a source (not shown) of energy in the microwave domain, for example at a frequency of 2.45 GHz.

More particularly, the applicators 24 consist of applicators known by the name of DECR (Distributed Electron Cyclotron Resonance) applicators.

Moreover, each applicator 24 is equipped with means for creating a static magnetic field in the vicinity of the applicator with an intensity corresponding to electron cyclotron resonance, that is to say a static magnetic field whose intensity B is related to the frequency f of excitation of an electron placed in this static magnetic field by the following equation:

$$B=2\pi\times m\times f/$$

in which m and e are the electron mass and the electron charge, respectively.

Thus, for incident microwave radiation having a frequency of 2.45 GHz, for example, the intensity of the static magnetic field created in the vicinity of each applicator is chosen to be 875 gauss.

In the embodiment shown in FIG. 1, the means for creating the static magnetic field consist of a magnet 26 of longitudinal shape and placed here inside each applicator 24.

This construction makes it possible to obtain a static magnetic field whose value decreases relatively quickly and thus to obtain a low, or even zero, static magnetic field in the region in which the part 12 to be treated is placed. Furthermore, because of the intense absorption of the microwave field in the vicinity of the applicators, the excitation of the plasma does not take place in the immediate vicinity of the substrate, thus reducing the risk of damaging the latter.

Finally, FIG. 1 shows that the reactor 10 also includes a set of metal bars such as 25, extending transversely and parallel to the applicators 24. These bars 25 are connected to ground, that is to say to the wall of the chamber 16, in order to form a ground reference along each applicator so as to structure the microwave field in this region and facilitate the propagation of the incident radiation.

Lastly, it may be seen that the reactor 10, in the case of the embodiment shown, includes an electric field source 30, for example, as here, having a frequency of 13.56 MHz, making it possible to bias the substrate holder, as will be described below.

The cleaning and the deoxyidation of the part 12 by means of reactor 10 as described above are carried out in the following manner.

In the rest of the description, the part 12 will be regarded as consisting of a steel sheet running over the substrate holder 14 under the action of conventional drive means (not shown).

Firstly, after having positioned the sheet 12 on the substrate holder 14, the chamber 16 is filled, by means of the nozzles 18, with a reducing gas mixture at low pressure, i.e. preferably of between 1 and 10 mTorr.

For example, the reducing gas mixture consists of hydrogen, optionally combined with argon or with another inert gas.

It will be understood that although according to the invention hydrogen is a preferred gas, other reducing gases can, of course, by envisioned.

Next, microwave power is injected by means of each applicator 24, in the vicinity of each inlet nozzle 18, and, simultaneously or successively, a static magnetic field, the intensity of which corresponds, as was mentioned above, to electron cyclotron resonance, is created in this region, that is to say in a region of the chamber 16, separate from the region in which the sheet 12 to be treated is placed.

It will be noted that the static magnetic field lines thus created form loops between two adjacent magnets. Thus a multipole magnetic field structure is defined between the applicators.

In this region, the electrons are exposed to the action of the microwaves and the electron cyclotron resonance effect, and thus may attain a high energy. The most energetic electrons are influenced little by the action of the self-consistent electromagnetic field of the plasma, responsible for the diffusion of the latter toward the volume of the chamber, and they therefore remain trapped on the multipole magnetic field lines.

These highly energetic electrons, as a result of ionizing inelastic collisions, cause the neutral species in the gas mixture lying in this region to dissociate, forming secondary electrons and ionized species, particularly $H^+$ (or else $H^+$ and $Ar^+$) ions. The latter can diffuse out of the trapping region due to the effect of the self-consistent electric field of the plasma. Radical species can then form within this plasma. Thus, a plasma filling substantially the entire internal volume of the chamber 16 is formed.

Thus, a highly dissociated and very active low-pressure hydrogen plasma is obtained, enabling the sheet 12 to be treated.

It will be noted that, as mentioned previously, the substrate holder 14 is optionally subjected to the influence of a high-frequency electric field, thereby allowing the latter to be biased.

This is because when the substrate holder 14 is subjected to the influence of a positive half-cycle of the electric field delivered by the source 30, the electrons are attracted toward the sheet 12, whereas when the substrate holder 14 is subjected to the influence of a negative half-cycle, the positive ions, in this case the $H^+$ ions, are attracted toward the sheet 12.

It will be understood that since electrons are more mobile than ions, the substrate holder is biased, the bias being adjustable under the control of the source 30.

It is thus possible to control the energy of the ions striking the surface of the sheet 12 to be treated.

Figure 2:
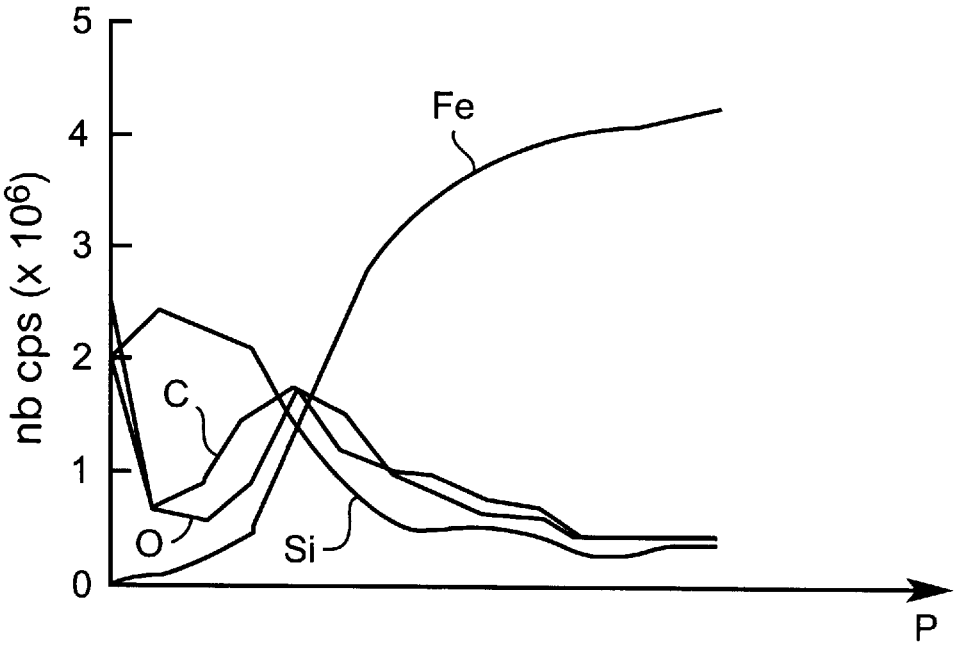
FIG. 2 PRIOR ART
FIG. 2 is an Auger profile of a metal sheet treated by conventional techniques.

FIG. 2 shows the Auger profile obtained using an Auger electron spectroscopy analysis, also known by the name "AES", technique, as a function of the depth P, for a steel sheet treated by conventional techniques. It may therefore be considered that this sheet is regarded at the present time as being clean within the user site in question by employing such conventional techniques for cleaning sheets in a liquid phase.

Figure 3:
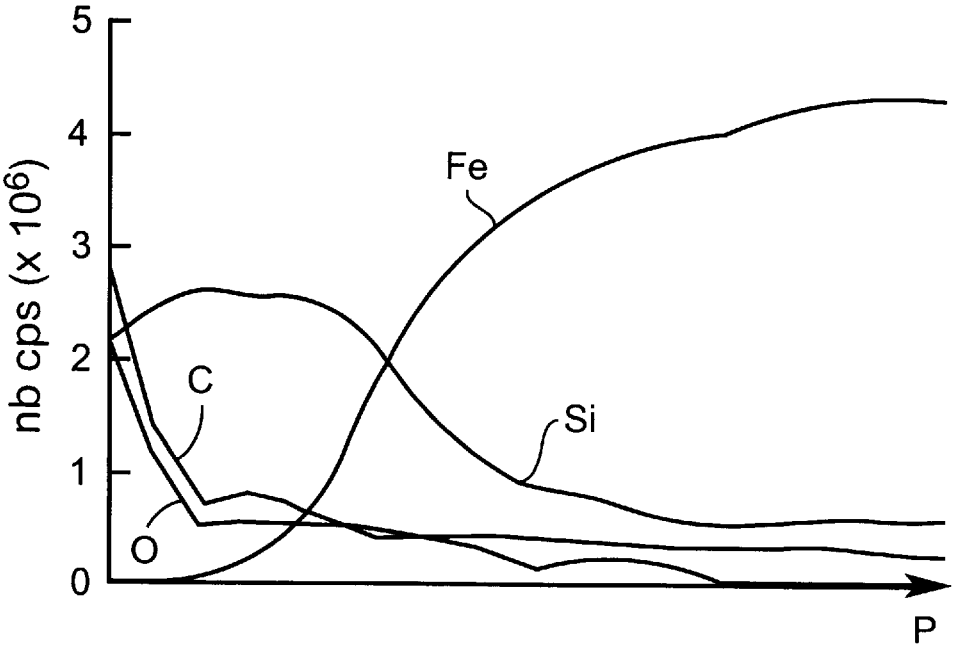
FIG. 3 is an Auger profile of a metal sheet treated by means of a hydrogen plasma using a method according to the invention.

FIG. 3 shows the Auger profile, as a function of the depth, for a substrate treated by means of a hydrogen plasma according to the invention, as described above, without the substrate holder being biased.

It will be noted that, in order to prevent the specimens from reoxidizing between their removal from the treatment chamber 16 and their insertion into an Auger spectrometer, an encapsulating layer of hydrogenated amorphous silicon is deposited in situ immediately after treatment, said encapsulating layer having a thickness of a few tens of nanometers, typically from 30 to 50 nanometers. During Auger analysis of the compositional profile as a function of the depth, this layer can be readily distinguished from the rest of the specimen.

Referring firstly to FIG. 2, it will be noted that oxygen and carbon are present in a significant amount in the transition region between the steel substrate and the silicon encapsulating layer. Of course, the oxygen is associated with iron oxide, whereas carbon indicates a residual contamination by hydrocarbons not removed by the solvent cleaning.

Referring now to FIG. 3, it can be seen that on the surface of the steel, that is to say in the transition region between the encapsulating layer and the surface of the sheet, the carbon and oxygen concentrations are considerably reduced.

Thus, the hydrogen plasma treatment according to the invention is not only capable of reducing the native iron oxides but also of removing the traces of hydrocarbons.

The surface treatment method that has just been described, making it possible to remove the residual surface hydrocarbons and to deoxidize this surface, also allows the adhesion of subsequent coatings to be considerably improved.

Figure 4:
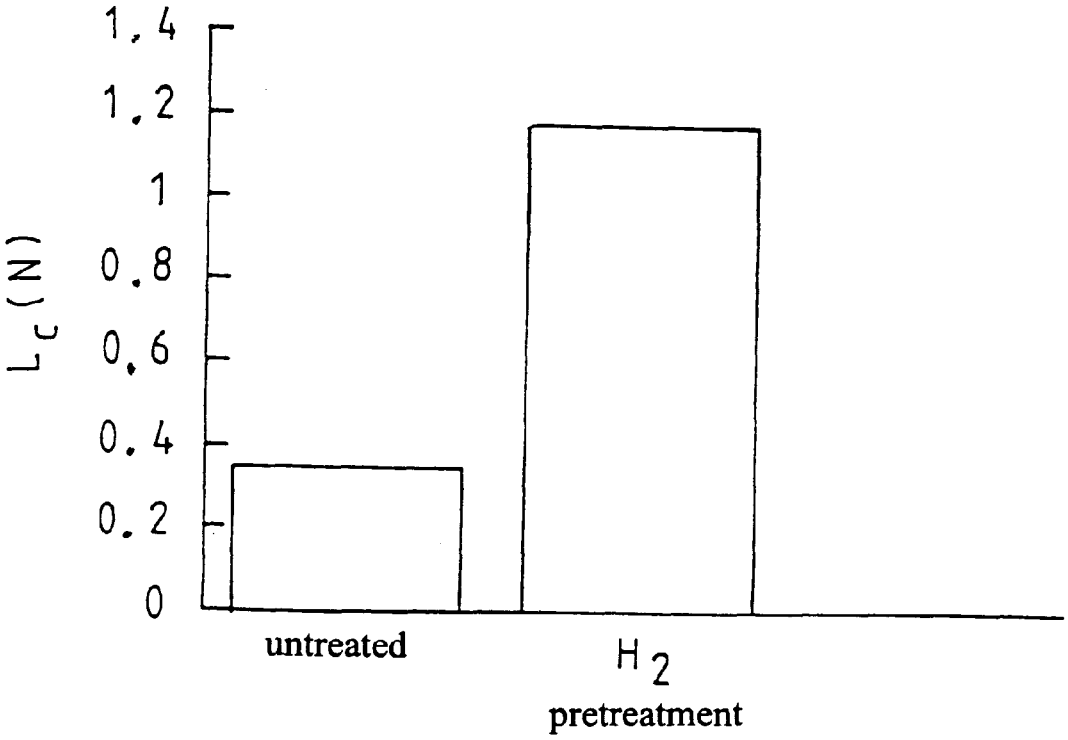
FIG. 4 illustrates the adhesion of a coating deposited on a surface treated by means of a method according to the invention.

FIG. 4 shows the result of tests used to evaluate the adhesion of a silica coating deposited as a thin film on surfaces treated in this way, consisting in applying an increasing force to a hard spike pressed against the coating, while the specimen to be analyzed is made to undergo a translational movement. The critical load $L_c$ corresponding to the onset of film flake-off is recorded.

For a surface treated using conventional techniques, that is to say using a solvent, FIG. 4 shows that the adhesion characterized in this way, is relatively mediocre since the critical load $L_c$ is 0.35 newtons.

By contrast, for a surface treated using a hydrogen plasma, the value of the critical load $L_c$ occurs at around 1.2 newtons, corresponding to an increase by a factor of approximately 4.

Thus, the surface treatment method that has just been described is extremely effective for providing satisfactory adhesion of the subsequent functional coatings, especially of coats of paint or an anticorrosion layer, such as a silica layer, which could be applied subsequently.

Furthermore, it makes it possible to considerably reduce the time required to treat the surfaces of metal parts.

Although the present invention has been described in relation to particular embodiments, it is not in any way limited thereby but is, on the contrary, capable of modifications and variants which will be apparent to those skilled in the art within the framework of the claims appended hereinafter.

Thus, for example, as mentioned above, although the notion of "low pressure" was most particularly described and exemplified in the foregoing as lying within the range extending from 0.5 to 10 mTorr, it will be understood that this condition must, above all, be understood as allowing actual excitation of the plasma under electron cyclotron resonance (ECR) conditions. It would then be possible to depart somewhat from this range while still remaining within the scope of the present invention provided that the conditions for an ECR regime are actually met.

What is claimed is:

1. A method for surface treatment of a metal part for the purpose of deoxidizing it and/or cleaning it, comprising the steps of:

filling a chamber, in which the part to be treated is placed, with a low pressure reducing gas mixture;

creating a static magnetic field in a region of the chamber separate from the region in which the part to be treated is located;

exciting the gas mixture by injecting an electromagnetic wave into the chamber so as to generate a treatment plasma in the gas, running said metal part through said chamber, wherein the static magnetic field has an intensity corresponding to an electron cyclotron resonance established in the chamber in a distributed manner.

2. The method according to claim 1, wherein said creation of a magnetic field and said excitation of the gas mixture take place simultaneously.

3. The method according to claim 1, wherein said creation of a magnetic field and said excitation of the gas mixture take place successively.

4. The method according to claim 1, further comprising injecting the electromagnetic wave with at least one applicator of tubular overall shape connected to a source of microwaves, in which at least one permanent magnet is placed.

5. The method according to claim 4, wherein the applicator or applicators have a length at least equal to one of the dimensions of the metal part to be treated.

6. The method according to claim 5, wherein the gas mixture includes hydrogen.

7. The method according to claim 1, wherein the pressure of the gas mixture is between 0.5 and 10 mTorr.

8. The method according to claim 1, wherein the incident electromagnetic wave has a frequency of approximately 2.45 GHz.

9. The method according to claim 1, wherein the incident electromagnetic wave has a frequency of approximately 5.85 GHz.

10. The method according to claim 1, wherein the part to be treated comprises a steel sheet running over a substrate holder.

11. The method according to claim 10, further comprising the step of applying a high-frequency electric field to the substrate holder so as to bias the latter.

12. Method according to claim 1, wherein the part to be treated rests on a substrate holder, the method furthermore including the step of applying a high-frequency electric field to the substrate holder so as to bias the latter.

13. The method according to claim 1, wherein the static magnetic field is created by excitation means comprising at least one field applicator connected to a microwave source, each applicator being equipped with means for creating a static magnetic field in the vicinity of the applicator.

14. An installation for surface treatment of a metal part for the purpose of deoxidizing it and/or cleaning it, comprising:

a sealed chamber including a region in which the part to be treated is run through;

a source of a reducing gas mixture, allowing the chamber to be filled with the reducing gas mixture at low-pressure;

means for creating a static magnetic field in a region of the chamber separate from the region in which the part to be treated is placed; and means for exciting the gas mixture with an electromagnetic wave injected into the chamber to generate a treatment plasma in the gas;

wherein the static magnetic field has an intensity corresponding to an electron cyclotron resonance, established in the chamber in a distributed manner, said excitation means comprising at least one field applicator of tubular overall shape connected to a microwave source, each applicator being equipped with means for creating a static magnetic field in the vicinity of the applicator, with an intensity corresponding to the electron cyclotron resonance.

15. The installation according to claim 14, wherein the applicator or applicators have a length at least equal to one of the dimensions of the metal part to be treated.

16. The installation according to claim 14, wherein said means for creating a static magnetic field in the vicinity of the applicator, comprise a permanent magnet placed inside each applicator.

17. The installation according to claim 14, wherein said source of a reducing gas mixture includes hydrogen.

18. The installation according to claim 14, further comprising a substrate holder capable of holding the part to be treated.

19. The installation according to claim 18, further comprising a means for making the part to be treated run over the substrate holder.

20. The installation according to claim 18, further comprising a means allowing a high-frequency electric field to be applied to the substrate holder so as to bias the latter.

* * * * *